US005919076A

United States Patent [19]

Abeyta

[11] Patent Number: 5,919,076

[45] Date of Patent: Jul. 6, 1999

[54] PLAY WHEEL HAVING PUSH GUIDE STICK

[76] Inventor: Joe G. Abeyta, 2465 Lark Dr., Colorado Springs, Colo. 80909

[21] Appl. No.: 09/055,207

[22] Filed: Apr. 6, 1998

[51] Int. Cl.[6] ..... A63H 33/02

[52] U.S. Cl. ..... 446/450; 446/448

[58] Field of Search ..... 446/240, 431, 446/448, 450, 451, 452, 453; D21/445, 457

[56] References Cited

U.S. PATENT DOCUMENTS

| | | | |
|---|---|---|---|
| 465,950 | 12/1891 | Rowe . | |
| 563,896 | 7/1896 | Urquhart . | |
| 955,009 | 4/1910 | Starmer et al. | 446/450 |
| 1,216,589 | 2/1917 | Meyner . | |
| 2,535,396 | 12/1950 | Dube . | |
| 3,475,855 | 11/1969 | Edwards | 446/431 |
| 3,494,069 | 2/1970 | Klimko . | |
| 3,603,028 | 9/1971 | Thorstad . | |
| 3,867,787 | 2/1975 | Weinger . | |
| 3,956,851 | 5/1976 | Tapinekis | 446/450 |
| 4,052,814 | 10/1977 | Hall | 446/450 |
| 4,897,069 | 1/1990 | Overturf | 446/450 |

FOREIGN PATENT DOCUMENTS

| | | | |
|---|---|---|---|
| 2417323 | 10/1979 | France | 446/450 |

*Primary Examiner*—Robert A. Hafer
*Assistant Examiner*—Jeffrey D. Carlson
*Attorney, Agent, or Firm*—G. F. Gallinger

[57] ABSTRACT

A more stimulating hoop which is able to be guided while rolling and which has sufficient internal friction so that it will not run away from a running child. The rolling play wheel comprises: a rim having an interior side portion, an exterior side portion, and opposite upright sidewalls, said interior side portion of the wheel having a track and a slide disposed in the track which remains in a lower portion of the wheel as it rolls along; a push guide stick having a wheel and a handle end portion, said wheel end portion adapted to receive the rim encircling the exterior side portion and the two upright sidewalls thereof.

6 Claims, 1 Drawing Sheet

PLAY WHEEL HAVING PUSH GUIDE STICK

FIELD OF INVENTION

This invention relates to hoops having push sticks. More particularly this invention relates to an improved hoop having a push guide stick used to push and steer the wheel.

BACKGROUND OF THE INVENTION

Children have long enjoyed pushing a hoop. It is a healthy aerobic activity which develops coordination. One problem with a rolling hoop is that it is difficult to guide once it is rolling. Another problem is that a rolling hoop soon attains a velocity which is difficult to run with. A common hoop is not very alluring to a child's eye. There is a niche for a more stimulating hoop which is able to be guided while rolling so that it may be rolled along a turning walkway. A hoop which would have sufficient internal friction so that it will not run away from a running child.

OBJECTS AND STATEMENT OF INVENTION

It is an object of this invention to disclose a play wheel having a push guide stick which is able to be steered along a twisting walkway. It is an object of this invention to disclose a wheel which has sufficient internal friction to prevent it from rolling too fast—a wheel which requires intermittent pushing to keep rolling. It is a final object of this invention to disclose a play wheel which generates noise and stimulates interest.

One aspect of this invention provides for a rolling play wheel comprising: a rim having an interior side portion, an exterior side portion, and opposite upright sidewalls; a push guide stick having a wheel and a handle end portion, said wheel end portion adapted to receive the rim encircling the exterior side portion and the two upright sidewalls thereof; wherein use the rolling play wheel may be pushed and steered with the push guide stick.

Another aspect of this invention provides for a play wheel as above wherein the interior side portion of the wheel comprises a track and wherein the wheel further comprises a slide which will slide in the track in a lower portion of the wheel as it rolls along.

Various other objects, advantages and features of novelty which characterize this invention are pointed out with particularity in the claims which form part of this disclosure. For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description makes reference to the annexed drawings wherein.

Figure 1:
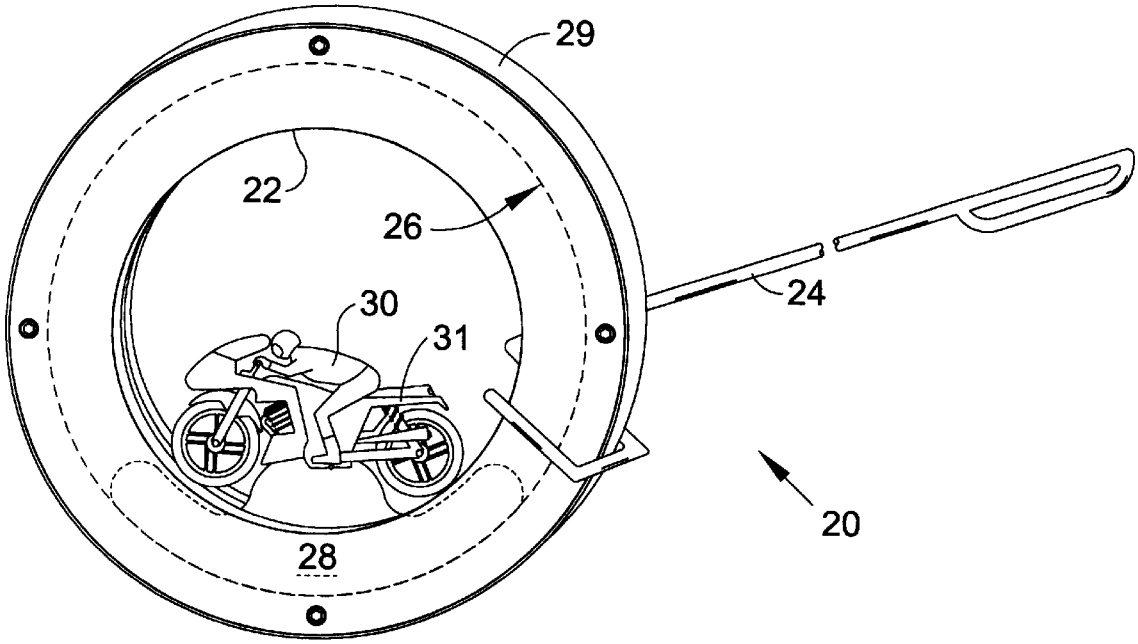
FIG. 1 is a perspective view of a play wheel having a push guide stick.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a perspective view of a rolling play wheel 20 comprising: a rim 22 having an interior side portion, an exterior side portion, and opposite upright sidewalls; a push guide stick 24 having a wheel and a handle end portion, said wheel end portion adapted to receive the rim 22 encircling the exterior side portion and the two upright sidewalls thereof. In use the rolling play wheel 20 may be pushed and steered with the push guide stick 24. The guide stick 24 may also be used to hook inside the rim 22, to stop the wheel 20, or alternatively slow the wheel 20 when it is rolling down a slope.

Most preferably the interior side portion of the rim 22 further comprises a track 26 and wherein the wheel 20 further comprises a slide 28 which slidably seats in the track 26 in a lower portion of the wheel 20 as it rolls along. In addition to providing interest, the slide 28 serves to generate internal friction so that the rim 22 will attain a maximum rolling speed that a child can keep up with, and additionally require the rim 22 to be pushed at a more frequent interval.

Figure 2:
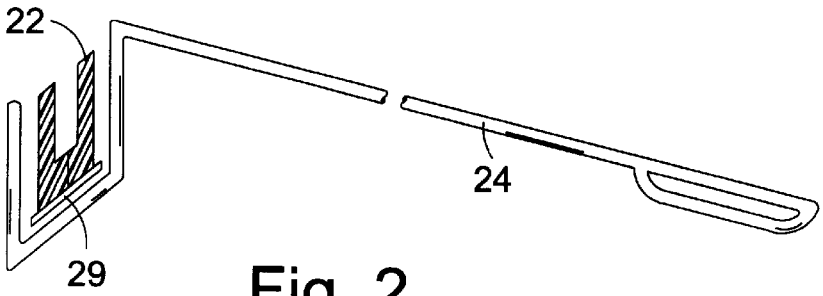
FIG. 2 is a perspective view of push guide stick and a cross sectional view of the rim of the play wheel shown in FIG. 1.

FIG. 2 is a perspective view of push guide stick 24 and a cross sectional view of the rim 22 of the play wheel 20 shown in FIG. 1. FIG. 2 best shows the shape of the track 28 formed in the internal side portion of the rim 22. FIG. 2 also shows the hoop 29 seated on the exterior side portion of the rim 22.

Figure 3:
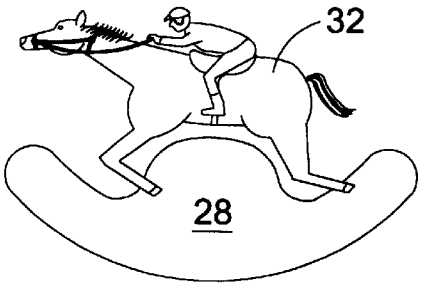
FIG. 3 is an alternative embodiment of a slide.
Figure 4:
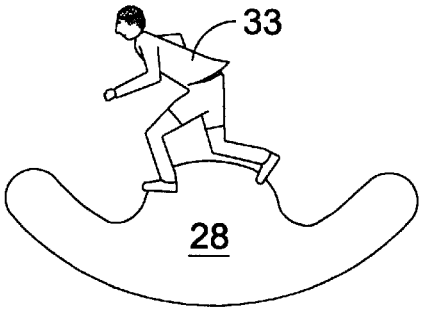
FIG. 4 is yet another embodiment of a slide for use with the rim of the play wheel shown in FIG. 1.

FIG. 3 is an alternative embodiment of a slide 28. In FIG. 1 the slide 28 carried a molded figure which was a motorcycle and race rider 30. Alternatively the molded figure may be a molded race horse and jockey 32 or a runner 33 as shown in FIG. 4.

In the preferred embodiment the slide carries a decorative figure. Most preferably the decorative FIG. 30 is i) a motorcycle and race rider 31; ii) a race horse and jockey 32; or alternatively, iii) a runner 33. Most preferably the slide 28 may be removed from the track 26 when it is lifted vertically.

In the most preferred embodiment of the invention the stick 24 is metal, and said play wheel further comprises a metal hoop 29 so that when the wheel 20 is struck with the push stick 24 a noise is generated. The rim 22, slide 28, and decorative FIG. 30 are made of plastic. Results have been most satisfactory when the push guide stick 24 is made from ¼" round bar, and has an overall length of 32".

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivalent relationships to those illustrated in the drawings, and described in the specification, are intended to be encompassed in this invention. What is desired to be protected is defined by the following claims.

I claim:

1. A rolling play wheel comprising:

a rim having an interior side portion having a track, an exterior side portion, and opposite upright sidewalls;

a plurality of slides each which may be vertically inserted into and removed from the track without any disassembly whatsoever, each carrying a different decorative figure, any one of which when vertically inserted into the track slidably seats therein so that the rim may alternatively carry, and ready interchange may be made between, the decorative figures;

a push guide stick having a wheel and a handle end portion, said wheel end portion adapted to receive the rim encircling the exterior side portion and the two upright sidewalls thereof;

where in use the rolling play wheel may be pushed and steered with the push guide stick.

2. A play wheel as in claim 1 wherein one of the figures is a molded motorcycle and race rider.

3. A play wheel as in claim 1 wherein one of the figures is a molded race horse and jockey.

4. A play wheel as in claim 1 wherein one of the figures is a runner.

5. A play wheel as in claim 1 wherein the stick is metal, and said play wheel further comprises a metal hoop so that when the wheel is struck with the push stick a noise is generated.

6. A play wheel as in claim 5 wherein the rim, slide, and decorative figure are made of plastic.

* * * * *